US006217041B1

(12) United States Patent
Hauser et al.

(10) Patent No.: US 6,217,041 B1
(45) **Date of Patent: *Apr. 17, 2001**

(54) SNOWBOARD

(75) Inventors: Ruedi Hauser; Shaw Kaake, both of Zurich (CH)

(73) Assignee: Marker Deutschland GmbH (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/991,494

(22) Filed: Dec. 16, 1997

(30) Foreign Application Priority Data

Dec. 19, 1996 (DE) ..... 196 52 779

(51) Int. Cl.[7] ..... B62B 13/04; A63C 5/07; A63C 5/04

(52) U.S. Cl. ..... 280/14.2; 280/602; 280/609

(58) Field of Search ..... 280/14.2, 14.3, 280/610, 602, 607, 609

(56) References Cited

U.S. PATENT DOCUMENTS

| | | | | |
|---|---|---|---|---|
| 3,861,698 | | 1/1975 | Greig . | |
| 5,141,243 | | 8/1992 | Meatto . | |
| 5,320,378 | * | 6/1994 | Wiig | 280/610 |
| 5,573,264 | * | 11/1996 | Deville et al. | 280/602 |
| 5,580,078 | * | 12/1996 | Vance | 280/14.2 |
| 5,855,389 | * | 1/1999 | Andrus et al. | 280/602 |
| 5,868,405 | * | 2/1999 | Lavecchia et al. | 280/14.2 |
| 5,871,224 | * | 2/1999 | Vance | 280/607 |

FOREIGN PATENT DOCUMENTS

| | | | |
|---|---|---|---|
| 681061 A5 | 1/1993 | (CH) | A63C/5/12 |
| 42 05 381A1 | 8/1992 | (DE) | A63C/5/00 |
| 0 622 086B1 | 11/1994 | (EP) | A63C/5/03 |
| WO91/09653 | 7/1991 | (WO) | A63C/5/07 |

* cited by examiner

*Primary Examiner*—Lanna Mai
*Assistant Examiner*—Jeff Restifo
(74) *Attorney, Agent, or Firm*—D. Peter Hochberg; Katherine R. Vieyra; William H. Holt

(57) ABSTRACT

The support structure is formed essentially by two support bands which are each assigned to one longitudinal edge of the snowboard. A central strip remaining therebetween is, at least at the longitudinal ends of the snowboard, designed to be very flexible in such a manner that the longitudinal ends of one support band can bend in the upward or downward direction of the snowboard as independently as possible of the longitudinal ends of the other support band.

26 Claims, 3 Drawing Sheets

SNOWBOARD

The invention relates to a snowboard—or a wide monoski—with a support or base structure which supports its running surface and longitudinal edges and has great rigidity in the transverse direction and relatively great flexibility in the vertical direction.

The flexibility of a snowboard as far as its vertical direction is concerned, i.e. the resilient resistance a snowboard offers to upward or downward bending of its longitudinal ends, has considerable influence on the riding characteristics.

When the snowboard slides in the longitudinal direction resting flat on the snow, it must be guaranteed, by correctly designed flexibility, that the two longitudinal ends of the snowboard can bend upward, in relation to the central region, in hollows in the ground and can bend in the opposite direction to a certain extent on humps or elevations.

The characteristics of a snowboard when ridden through a curve are determined on the one hand by its waisting or central longitudinal portion—the central region of the snowboard usually has a smaller width than the longitudinal ends (shovels) of the snowboard—and on the other hand by the flexibility of the respective longitudinal edge on the inside of the curve. During riding through a curve, the snowboard is edged, i.e. tilted laterally, so that practically only its longitudinal edge on the inside of the curve remains in contact with the snow, while the longitudinal edge on the outside of the curve is lifted off the snow to a greater or lesser extent. The degree of the inclined position, the waisting and also the flexibility of the edge on the inside of the curve then determine the respective curvature of the longitudinal edge on the inside of the curve. In the optimum case, this curvature corresponds to the greatest possible extent to the curvature of the track actually ridden through, so that only very minor lateral drift of the snowboard occurs and the snowboard cuts a narrow curved track into the snow with its longitudinal edge on the inside of the curve. Riding through curves in this manner is also known as carving.

Moreover, there are other riding maneuvers which involve predominantly unilateral loading of the snowboard.

The object of the invention then is to provide a snowboard, the flexibility of which is particularly well adapted or can be particularly well adapted in design terms to different riding conditions.

This object is achieved according to the invention in that there is provided a longitudinally divided support or base structure including a core with two support bands, each assigned to one of the longitudinal edges, and with a central strip which decouples the two support bands from one another at least in the longitudinal end regions and/or makes possible different upward or downward bending of the longitudinal ends of the two support bands relative to one another.

The invention is based on the general idea of assigning the two longitudinal edges of the snowboard separate support structures which are decoupled from one another in such a manner that upward or downward bending of the longitudinal ends of one support band leads to no or to only limited corresponding bending of the other support band.

In this manner, it is ensured that, during sliding riding in the longitudinal direction of the snowboard with the snowboard resting flat on the snow, the flexibility of the snowboard on riding through hollows or over bumps is determined by the two support bands together.

In so far as consecutive hollows and bumps have different or even opposite lateral gradients, the longitudinal ends or end shovels of the snowboard can twist relatively easily in relation to one another relative to the longitudinal axis of the snowboard, so that the snowboard is capable of hugging the ground contour.

When, during riding through curves with the snowboard tilted laterally, i.e. "edged", only the snowboard edge on the inside of the curve engages in the snow, the flexibility of this edge is determined essentially by the assigned support band and only to a very limited extent by the support band of the other longitudinal edge.

As a result, therefore, the rigidity of the snowboard which is effective for the respective riding maneuver is reduced when the snowboard is loaded predominantly only unilaterally or, in the edged or laterally tilted position, engages in the snow only unilaterally with one longitudinal edge. In the case of changing transverse gradients, both longitudinal edges can maintain ground contact.

According to a preferred embodiment of the invention, the central regions of the snowboard between the support bands have, in particular at the longitudinal ends of the snowboard, a thickness in the vertical direction of the snowboard which is small in comparison with the support bands, so that the central strip is significantly more flexible than the support bands and forms a distinct trough on the upper side of the snowboard between the support bands, and mutually distinctly decoupled movements of the support bands are made possible.

The trough(s) also offer(s) the advantage that, for the use of tow lifts, when one foot of the snowboarder is to be released from the assigned binding, a recessed standing surface is available for this "free" foot, the beads formed by the support bands preventing the free foot from slipping off.

In the region of standing surfaces or support surfaces for snowboard bindings, crossbars can be provided between the support strips for receiving or arranging anchoring points for snowboard bindings.

In other respects, as far as preferred features of the invention are concerned, the reader is referred to the claims and also to the following explanation of the drawing, with reference to which a particularly preferred embodiment of the invention is described and in which:

DETAILED DESCRIPTION OF DRAWINGS

Figure 1:
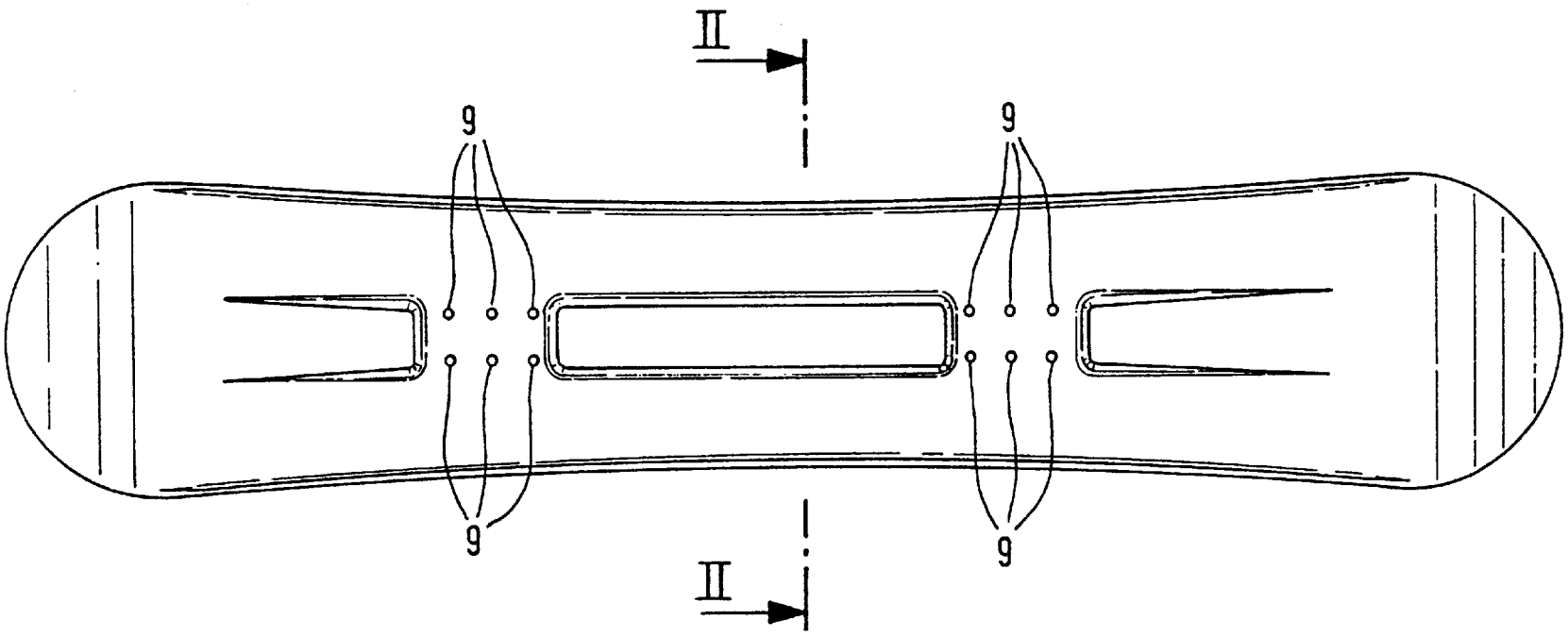
FIG. 1 shows a top view of the snowboard according to the invention.

The snowboard according to the invention has a flexible running surface 1 which consists essentially of a coating layer 2, which forms the actual sliding surface of the snowboard, and, supporting this, a highly loadable and in particular tension-resistant underlayer 3 which may be reinforced with glass fibers and/or carbon fibers or the like and, at its longitudinal borders, is connected firmly to steel edges 4 which, with downwardly angled edges, form the lateral borders of the coating layer 2.

Arranged adjacent to the two steel edges 4 on the upper side of the longitudinal borders of the running surface 1 are two stable support bands 5 and 6 which may consist of flexible wood layers glued together or may be designed as wood parts of flat-band type.

In principle, however, other materials, for example plastic materials, are also suitable for the support bands 5 and 6, and the support bands 5 and 6 may in principle have a structure which is known for conventional skis—for example a structure resembling a ski with a torsion box.

Arranged on the upper side of the underlayer 3, in a central strip remaining between the support bands 5 and 6, is an upper layer 7 which may consist of a plastic material—e.g. Isocore—or have marked intrinsic damping. This upper layer 7 is significantly thinner in the vertical direction of the snowboard than the support bands 5 and 6, so that the upper side of the upper layer 7 lies correspondingly lower than the upper side of the support bands 5 and 6. Support bands 5 and 6 and upper layer 7 form a central core of the support or base structure of the snowboard.

Provision is made only in the region of fastening points 9 to design the upper layer 7 with greater thickness or to embed highly loadable insert parts or crossbars in the upper layer, so that, in these regions, the support bands 5 and 6 are supported comparatively rigidly in relation to one another in the transverse direction of the snowboard and secure and highly loadable anchoring of the snowboard bindings is made possible at the fastening points 9.

If necessary, a frame-type composite construction can be ensured between the support bands 5 and 6 by the insert pieces or crossbars.

This composite construction is preferably designed in such a manner that a certain twisting of the central section of the snowboard relative to the longitudinal axis of the snowboard is made possible between the front and rear fastening points 9 of the snowboard seen in its longitudinal direction. Using corresponding foot force, the snowboarder can then, if necessary, actively bring about twisting of the snowboard.

The upper side of the snowboard is formed by a covering layer 10 which is preferably designed as a laminate and may if necessary have an underside layer reinforced by glass fibers or carbon fibers or the like. The covering layer 10 is shaped or preshaped in such a manner that, with smooth transitions, it covers the upper sides of the upper layer 7 and also of the support bands 5 and 6 and follows the longitudinal lateral borders of the underlayer 3 and of the steel edges 4.

In the snowboard according to the invention, the central strip between the support bands 5 and 6 is designed, in particular at the generally shovel-shaped longitudinal ends of the snowboard, to be "flexible in the manner of a diaphragm" in comparison with the support bands 5 and 6, with the result that the longitudinal ends of one support band 5 or 6 are capable of moving in the upward or downward direction of the snowboard as independently as possible of the longitudinal ends of the respectively other support band 6 or 5. This produces the particular flexibility explained in the introduction.

As the snowboarder stands on the snowboard with the feet at an angle to the longitudinal direction of the snowboard, it is generally desirable to design the support bands 5 and 6 with different bending characteristics. In particular, the support bands 5 and 6 may have different thicknesses and also a wedge profile, e.g. in such a manner that the wedge profile of the thicker support band 5 or 6 continues the wedge profile of the other support band 6 or 5.

Figure 2:
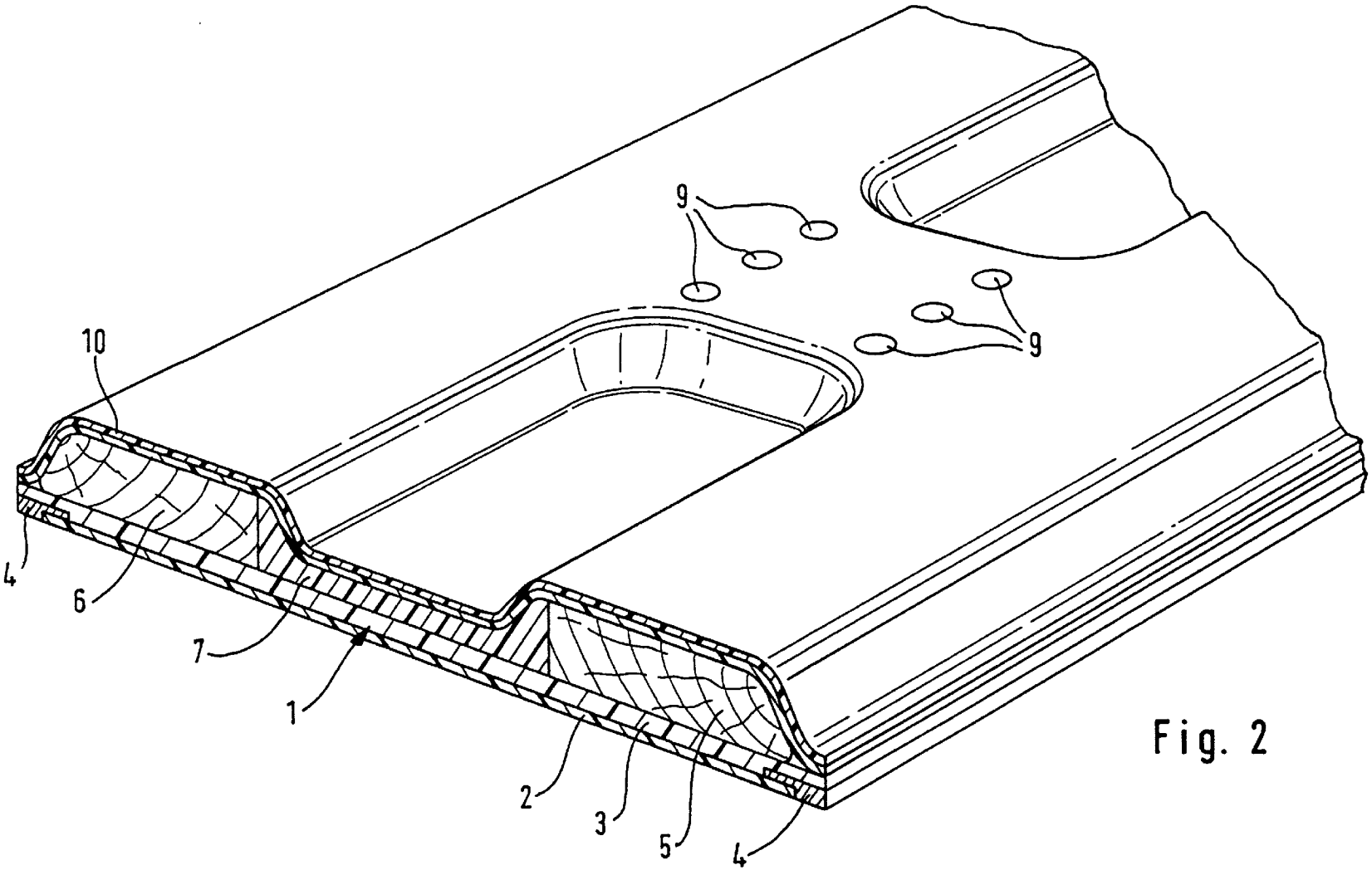
FIG. 2 shows a perspective sectional view along section line II—II in FIG. 1.
Figure 3:
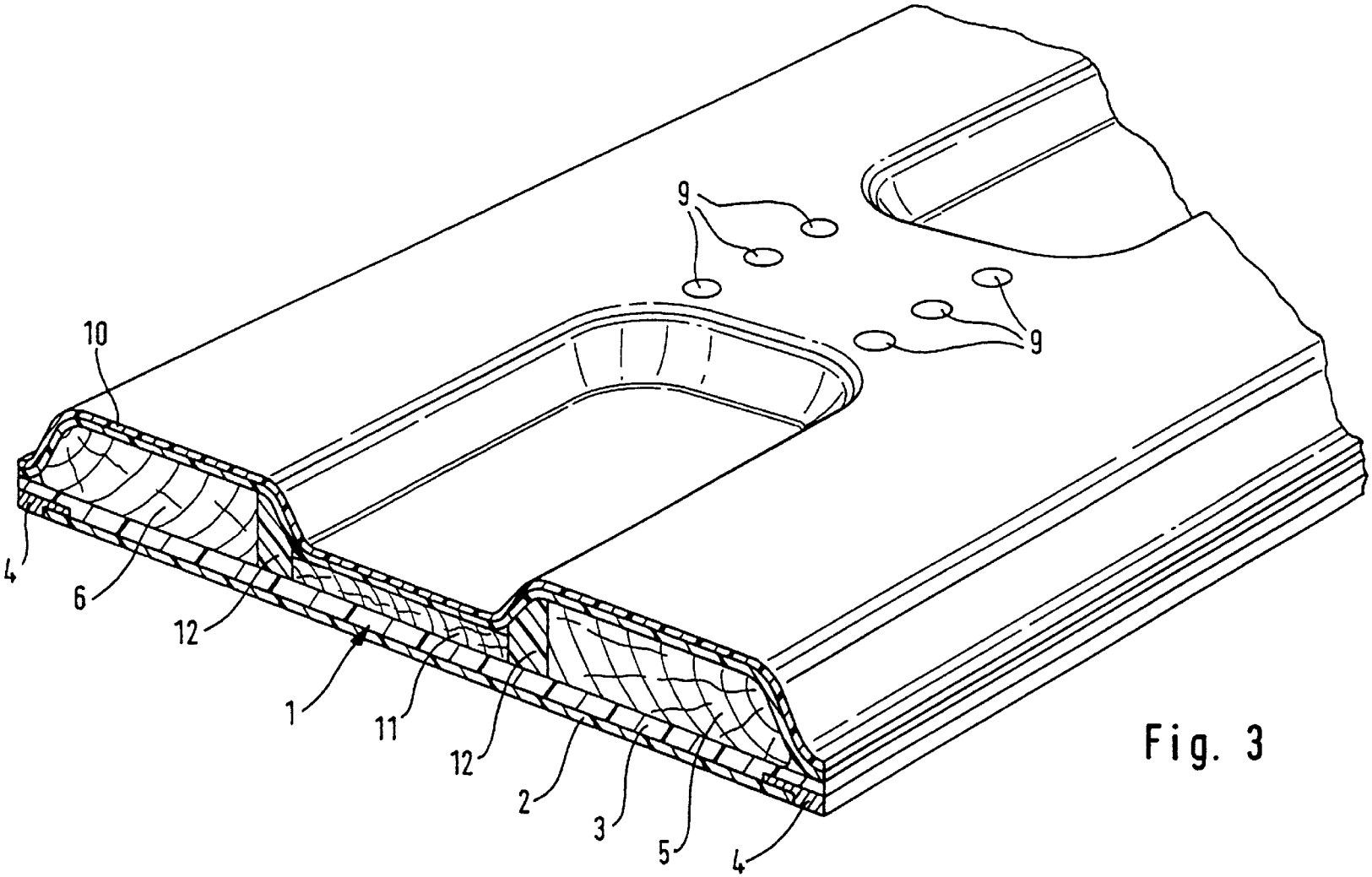
FIG. 3 shows a sectional view corresponding to FIG. 2 of a modified embodiment.

The embodiment illustrated in FIG. 3 differs from the embodiment in FIG. 2 essentially in that, in the central strip between the support bands 5, 6, a reinforcing band 11 of flat-band type is arranged on the underlayer 3 and may consist of the same material as the support bands 5, 6 or be constructed in fundamentally the same way as the support bands 5, 6, but preferably has, in the vertical direction of the snowboard, a significantly reduced thickness in relation to the support bands.

Preferably relatively broad longitudinal gaps, which are filled with plastic material 12, e.g. Isocore, remain between the reinforcing band 11 and the support bands 5, 6, and this material may form ramp-type transitions between the upper sides of the reinforcing band 11 and of the support bands 5, 6.

In all the embodiments illustrated, the thickness of the support bands 5, 6 in the vertical direction of the snowboard may correspond to the usual thickness of conventional structural parts of snowboards, while the central strip between the support bands 5, 6, in comparison with conventional snowboards, is of significantly more pliable design and guarantees at least marked decoupling of the support bands 5, 6 from one another.

If necessary, it is also possible for a trough-shaped design of the upper side of the snowboard in the region of the central strip to be dispensed with and an essentially plane upper side to be provided. For example, the troughs in FIGS. 2 and 3 may be filled by pliable plastic-foam material so that the upper layer 8 forms a continuous plane. It is important to design or structure the central strip in such a manner that the support bands 5, 6 are decoupled from one another.

What is claimed is:

1. A snowboard with a base structure which supports its running surface and longitudinal edges and has great rigidity in the transverse direction and relatively great flexibility in the vertical direction, wherein there is provided a longitudinally divided core, said core comprising two support bands, each assigned to one of the longitudinal edges and extending between the running surface and the upper part of the snowboard, and with a central strip which decouples the two support bands from one another at least in the longitudinal end regions and/or makes possible different upward or downward bending of the longitudinal ends of the two support bands relative to one another, wherein in the region of fastening points for snowboard bindings, the central strip between the support bands is designed with greater thickness and has an upper side extending in the same plane as the upper side of the support bands.

2. The snowboard as claimed in claim 1, wherein the central strip between the support bands is of pliable or flexible design in comparison with the support bands.

3. The snowboard as claimed in claim 1, wherein the upper side of the snowboard between the support bands is of trough-type recessed design.

4. The snowboard as claimed in claim 1, wherein the thicknesses of the support bands in the vertical direction of the snowboard are differently dimensioned.

5. The snowboard as claimed in claim 4, wherein the support bands have a wedge-shaped profile with a wedge angle open in the lateral direction.

6. The snowboard as claimed in claim 5, wherein the wedge angles of the two profiles are open in the same lateral direction.

7. The snowboard as claimed in claim 1, wherein the support bands are designed as strips of flat-band type and arranged in longitudinal lateral regions of a possibly multilayer running surface of the snowboard, which forms the underside of the snowboard.

8. The snowboard as claimed in claim 1, wherein a plastic coating, which is pliable in comparison with the support bands, is arranged on a central strip of the running surface between the support bands.

9. The snowboard as claimed in claim 1, wherein a reinforcing band of flat-band type is formed in a central strip between the support bands, and gaps are formed between this reinforcing band and the support bands.

10. The snowboard as claimed in claim 9, wherein the gaps are filled with material, in particular plastic, which is pliable in comparison with the support bands and with the reinforcing band.

11. The snowboard as claimed in claim 9, wherein the reinforcing band has a smaller thickness than the support bands in the vertical direction of the snowboard.

12. The snowboard as claimed in claim 9, wherein the reinforcing band has a smaller thickness than the support bands in the vertical direction of the snowboard.

13. The snowboard as claimed in claim 1, wherein at least one of the support bands and the reinforcing band are designed as wood parts.

14. The snowboard as claimed in claim 13, wherein said wood parts are glued-together composite wood parts composed of a number of layers.

15. The snowboard as claimed in claim 13, wherein said wood parts are glued-together composite wood parts composed of a number of strips.

16. A snowboard with a base structure which supports its running surface and longitudinal edges and has great rigidity in the transverse direction and relatively great flexibility in the vertical direction, wherein there is provided a longitudinally divided core with two support bands, each assigned to one of the longitudinal edges, and with a central strip which decouples the two support bands from one another at least in the longitudinal end regions and/or makes possible different upward or downward bending of the longitudinal ends of the two support bands relative to one another; said central strip having portions with a greater rigidity in the transverse direction extending between said support bands, said portions having fastening points for a snowboard binding to be located on said fastening points.

17. The snowboard as claimed in claim 16, wherein the central strip between the support bands is of pliable or flexible design in comparison with the support bands.

18. The snowboard as claimed in claim 16, wherein the upper side of the snowboard between the support bands is of trough-type recessed design.

19. The snowboard as claimed in claim 16, wherein the thicknesses of the support bands in the vertical direction of the snowboard are differently dimensioned.

20. The snowboard as claimed in claim 19, wherein the support bands have a wedge-shaped profile with a wedge angle open in the lateral direction.

21. The snowboard as claimed in claim 20, wherein the wedge angles of the two profiles are open in the same lateral direction.

22. The snowboard as claimed in claim 16, wherein the support bands are designed as strips of flat-band type and arranged in longitudinal lateral regions of a multilayer running surface of the snowboard, which forms the underside of the snowboard.

23. The snowboard as claimed in claim 16, wherein a plastic coating, which is pliable in comparison with the support bands, is arranged on a central strip of the running surface between the support bands.

24. The snowboard as claimed in claim 16, wherein a reinforcing band (11) of flat-band type is formed in a central strip between the support bands, and gaps are formed between this reinforcing band and the support bands.

25. The snowboard as claimed in claim 24, wherein the gaps are filled with material 12, in particular plastic, which is pliable in comparison with the support bands and with the reinforcing band.

26. The snowboard as claimed in claim 16, wherein the support bands and/or the reinforcing band are designed as wood parts, in particular as glued-together composite wood parts, which are composed of a number of layers and/or strips.

* * * * *